United States Patent [19]

Mori

[11] Patent Number: 4,984,525

[45] Date of Patent: Jan. 15, 1991

[54] WORK CUTTING ATTACHMENT FOR ZIGZAG SEWING MACHINES

[76] Inventor: Mikio Mori, 12-2, Chidori-cho 3-chome, Ogaki-shi, Gifu-ken, Japan

[21] Appl. No.: 397,316

[22] Filed: Aug. 23, 1989

[30] Foreign Application Priority Data

Aug. 31, 1988 [JP] Japan ..... 63-219482

[51] Int. Cl.[5] ..... D05B 37/06

[52] U.S. Cl. ..... 112/128

[58] Field of Search ..... 112/122, 128, 129, 257

[56] References Cited

U.S. PATENT DOCUMENTS

| | | | |
|---|---|---|---|
| 2,443,369 | 6/1948 | Alifano et al. | 112/128 |
| 4,389,952 | 6/1983 | Dreier et al. | 112/128 |
| 4,625,663 | 12/1986 | Mori | 112/128 |
| 4,811,672 | 3/1989 | Nishi | 112/128 |

*Primary Examiner*—Werner H. Schroeder

*Assistant Examiner*—David K. Suto

*Attorney, Agent, or Firm*—Dennison, Meserole, Pollack & Scheiner

[57] ABSTRACT

A work cutting attachment for use with a zigzag sewing machine having a presser bar, an endwise reciprocating needle bar and a feed dog. The attachment includes a base plate removably secured to the presser bar, a presser foot mounted on the base plate for holding a work fabric against the feed dog and having a needle clearance aperture, a fixed blade secured to the presser foot, a cutting blade operable in cooperation with the fixed blade, a support mechanism for supporting the cutting blade for vertical movement relative to the fixed blade, and a driving mechanism operatively connected to the needle bar for transmitting the vertical movement of the needle bar through the support mechanism to the cutting blade so as to move the latter vertically relative to the fixed blade.

6 Claims, 5 Drawing Sheets

WORK CUTTING ATTACHMENT FOR ZIGZAG SEWING MACHINES

BACKGROUND OF THE INVENTION

1. Field of the Invention

The present invention relates to work cutting attachments for zigzag sewing machines and more particularly, it relates to such attachments in which the work cutting operation is performed by using the source of drive of the sewing machines.

2. Description of the Prior Art

Heretofore, such cutting attachments have been used, particularly in zigzag sewing machines, to cut the hem of a work fabric while it is hemstitched with various stitches. The previously known cutting attachments are of the type secured to the table of a sewing machine by means of screws. For this reason, therefore, it has been necessary to form individual screw holes in sewing machines. Generally, it is difficult, if not impossible, for the user of sewing machines to provide such screw holes for himself, and in order to use such cutting attachments, the user has to purchase a specific sewing machine having individual screw holes for mounting the cutting attachments. Thus, the versatility of previously known cutting attachments is significantly reduced.

Additionally, when such cutting attachments are used for ordinary zigzag sewing machines, trim or chips produced by the cutting attachment tend to be caught on the presser foot of the sewing machine and to be curled thereby. Thus, work advancement and sewing operation may sometimes be impeded.

In order to eliminate the noted difficulties, the inventor of the present invention has previously proposed a work cutting attachment which may be readily mounted on a zigzag sewing machine and which includes a special presser foot operable to feed a work fabric smoothly without curling a cut trim. The work cutting attachment is shown in U.S. Pat. No. 4,625,663 issued Dec. 2, 1986.

In common construction for sewing machines, the presser foot is pressed against the work feeding mechanism of the sewing machine and therefore, it is required to be movable slightly longitudinally or vertically in accordance with the movement of the feeding mechanism. To this end, in the above U.S. patent, the presser foot is pivotally supported by a support arm secured to a base plate. A fixed blade is mounted on a support plate secured to the base plate so as to cooperate with a vertically movable cutting blade to perform a cutting operation. In such a work cutting attachment, the work cutting position and the sewing position should preferably be located close to each other, so that when the work fabric is cut and sewn, there is no possibility of shifts of the fabric position. However, with the construction of the U.S. patent in which the presser foot and the member for supporting the cutting blade are separately provided, there is a limit in arranging the cutting position close to the sewing position. Also, the construction around the presser foot tends to become complicated. Thus, improvement in these components has still been desired.

SUMMARY OF THE INVENTION

It is, accordingly, an object of the present invention to provide a work cutting attachment which uses a reduced number of components and which is relatively simple in construction and inexpensive to manufacture.

It is another object of the present invention to provide a work cutting attachment in which the cutting position is located close to the sewing position so as to minimize shifts of a work fabric as it is fed from the cutting position to the sewing position.

According to the present invention, there is provided a work cutting attachment for use with a zigzag sewing machine having a presser bar, an endwise reciprocating needle bar and a feed dog. The attachment comprises a base plate removably secured to the presser bar, a presser foot mounted on the base plate for holding a work fabric against the feed dog and having a needle clearance aperture, a fixed blade secured to the presser foot, a cutting blade operable in cooperation with the fixed blade, a support mechanism for supporting the cutting blade for vertical movement relative to the fixed blade, and a driving mechanism operatively connected to the needle bar for transmitting the vertical movement of the needle bar through the support mechanism to the cutting blade so as to move the latter vertically relative to the fixed blade.

In the present invention, the fixed blade is secured to the presser foot, so that a separate member for supporting the fixed blade is eliminated, and the overall construction of the device may be simplified. In addition, since the fixed blade may be located close to the needle clearance aperture, the work fabric may be sewn immediately after it has been cut, thereby avoiding possible work shifts during the sewing operation.

Preferably, the presser foot is connected to the base plate through a plurality of pins. The length of the shank of each pin is greater than the total thickness of the presser foot and the base plate. The presser foot and the base plate each has a plurality of holes. The diameter of each hole of the presser foot is larger than that of the shank of the pin, and the diameter of each hole of the base plate is substantially equal to that of the shank of the pin, such that the shank of the pin is loosely inserted into the hole of the presser foot and closely inserted into the hole of the base plate with the end of the pin secured to the base plate.

The range of vertically reciprocating movement of the cutting blade imparted by the driving mechanism is limited to a range within which the cutting blade cooperates with the fixed blade at all times, and the support mechanism includes a spring operable to press the cutting blade against the fixed blade. Thus, the work fabric may be cut both reliably and smoothly by the cutting blade and the fixed blade.

The support mechanism includes a swing lever pivotally supported on the presser foot, and the cutting blade is secured to one end of the swing lever. With this arrangement, both of the fixed blade and the cutting blade are supported by the single presser foot, so that the construction of the cutting attachment may be further simplified.

The driving mechanism includes a first lever pivotally supported on the base plate and having one end operatively connected to the needle bar, and a second lever having one end pivotally connected to the other end of the first lever and the other end pivotally connected to the other end of the swing lever.

Further, the driving mechanism is operable to drive the presser foot for lateral movement, so that the work cutting operation may be performed more reliably by the cutting blade and the fixed blade. Thus, a relatively thick fabric may be positively cut.

The present invention will become more fully apparent from the claims and description as it proceed in connection with the drawings.

DETAILED DESCRIPTION OF THE PREFERRED EMBODIMENT

Figure 1:
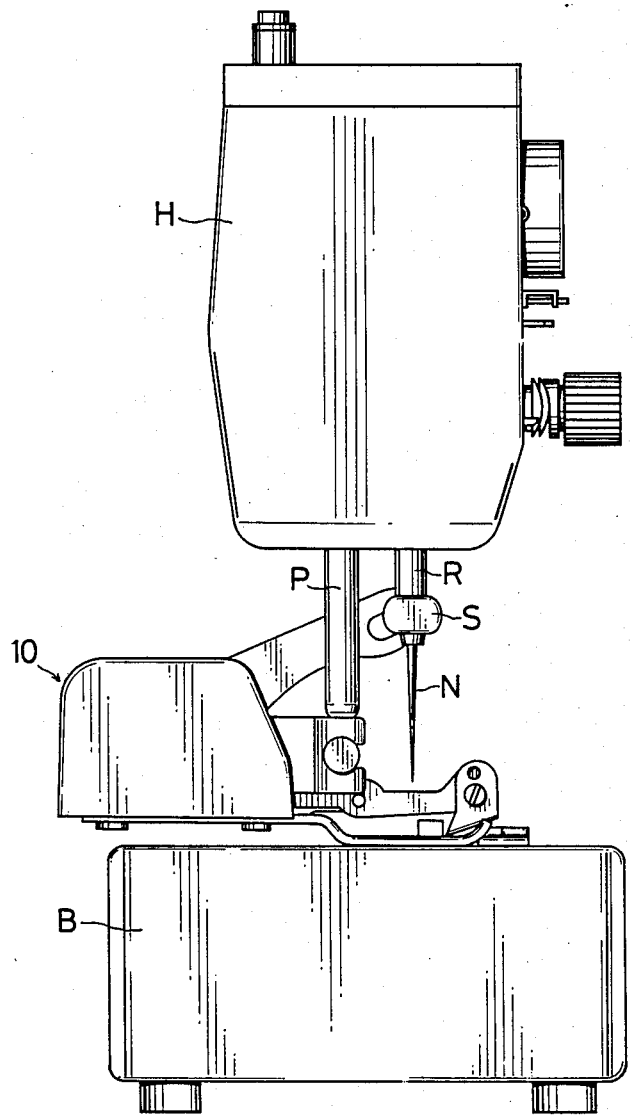
FIG. 1 is a side view of a work cutting attachment of the present invention applied to a zigzag sewing machine.

Referring to the drawings and to FIG. 1 in particular, the work cutting attachment 10 of the present invention is illustrated as applied to a zigzag sewing machine. As shown therein, the machine includes a head H, a presser bar P, a reciprocable needle bar R, a needle clamp S, a needle N, and a bed B. The attachment 10 of the present invention is disposed on the bed B and is attached to the presser bar P as will be hereinafter described in greater detail.

Figure 2:
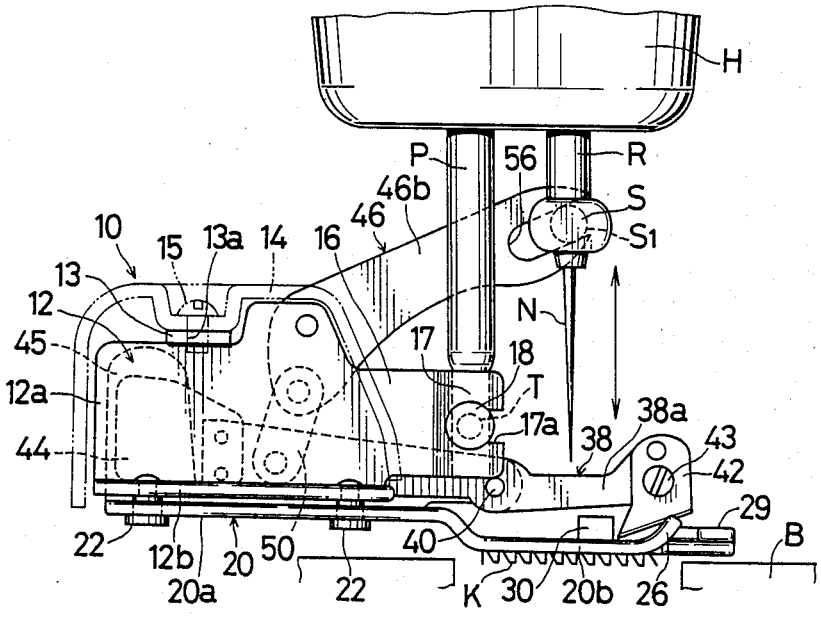
FIG. 2 is an enlarged side view, with the cover removed for clarity, of the attachment shown in FIG. 1.
Figure 3:
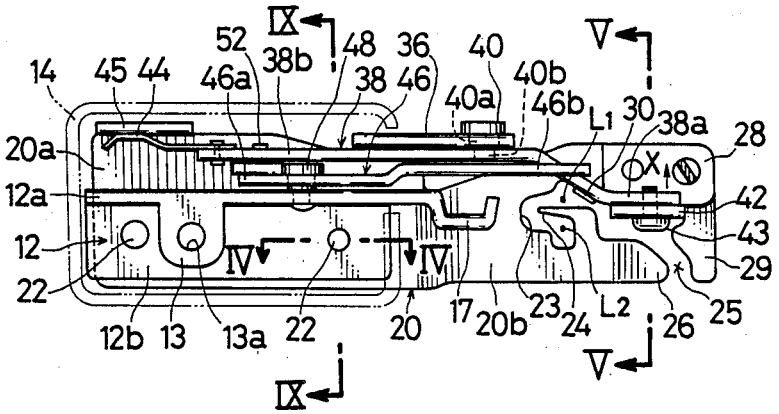
FIG. 3 is a plan view of the attachment shown in FIG. 2.

The construction of the attachment 10 will be described with reference to FIGS. 2 and 3. As shown therein, the attachment 10 includes a base plate 12 having a vertical wall portion 12*a* and a horizontal base portion 12*b*. The wall portion a has a horizontal lug 13 extending therefrom. The lug 13 has a threaded hole 13*a* in which a mounting screw 15 for a cover 14 threadedly engages. The wall portion 12*a* also has an integral mounting arm 16 for connection to the presser bar P. The mounting arm 16 has a hook portion 17 for engagement with the presser bar P. The hook portion 17 has formed therein a cutout portion 17*a* through which a set screw 18 is received. The presser bar P has a threaded hole T in which the set screw 18 is threadably engageable. Thus, to secure the mounting arm 16 to the presser bar P, the set screw 18 is passed through the cutout portion 17*a* and screwed into the threaded hole T.

A presser foot 20 is mounted on the lower surface of the base portion 12*b* of the base plate 12 and has a front portion 20*a* and a rear portion 20*b*. The front portion 20*a* is mounted on the lower surface of the base portion 12*b* through a pair of longitudinally spaced pins 22. The rear portion 20*b* of the presser foot 20 extends parallel to and below the longitudinal extent of the front portion 20*a*. When the attachment 10 is mounted on the sewing machine as shown in FIGS. 1 and 2, the rear portion 20*b* is located in opposed relation to a feed dog K (FIG. 2) of the sewing machine, so that a work fabric to be sewn and cut may be held between the rear portion 20*b* and the feed dog K. As shown in FIG. 3, the rear portion 20*b* also has a needle clearance aperture 23 and a projection 24 extending into the clearance aperture 23 between needle locations $L_i$ and $L_2$. The task of the projection 24 will be described later. The needle clearance aperture 23 communicates with the exterior of the attachment 10 through a communicating slit 25 formed in the rear end of the rear portion 20*b*. The rear portion 20*b* further has an upwardly bent portion 26 formed in front of the communicating slit 25. A fixed blade 28 is provided immediately behind the projection 24 and is secured to one side of the rear end of the rear portion 20*b*. The fixed blade 28 cooperates with a cutting blade 42, which will be described later, to cut a work fabric. A guide section 29 is formed on the rear portion 20*b* adjacent the fixed blade 28 and has an upper surface substantially flush with the upper surface of the fixed blade 28. An upstanding guide member 30 is provided adjacent the needle clearance aperture 23 and is adapted to guide a trim of the work fabric cut by the cutting blade 42 and the fixed blade 28.

Figure 4:
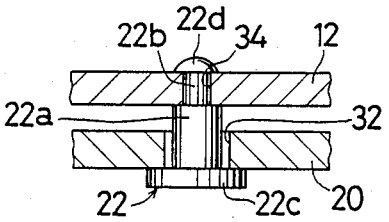
FIG. 4 is an enlarged sectional view taken along line IV—IV in FIG. 3.

Referring now to FIG. 4, the structure for mounting the presser foot 20 on the base plate 12 will be described in greater detail. As shown therein, each of the pins 22 has an enlarged shank portion 22*a*, a reduced shank portion 22*b* and a head 22*c*. The presser foot 20 has a through hole 32 having a diameter larger than that of the enlarged shank portion 22*a*, and the base plate 12 has a through hole 34 having a diameter substantially equal to that of the reduced shank portion 22*b*. The pin 22 is passed through the presser foot 20 such that the enlarged shank portion 22*a* is passed through the through hole 32 of the presser foot 20, and then the reduced shank portion 22*b* is passed through the through hole 34 of the base plate 12. The reduced shank portion 22*b* is then crimped at 22*d* to fix the base plate 12 and the pin 22 with the base plate 12 retained on a stepped portion between the enlarged shank portion 22*a* and the reduced shank portion 22*b*. The length of the enlarged shank portion 22*a* is suitably greater than the thickness of the preseser foot 20, so that the presser foot 20 is vertically movable between the base plate 12 and the head 22*d* of the pin 22 and is laterally tiltable relative to the base plate 12 by virtue of the difference between the diameter of the enlarged shank portion 22*a* and that of the through hole 32. In addition, it will be noted that the presser foot 20 is longitudinally tiltable according to the distance between the longitudinally spaced pins 22.

Figure 5:
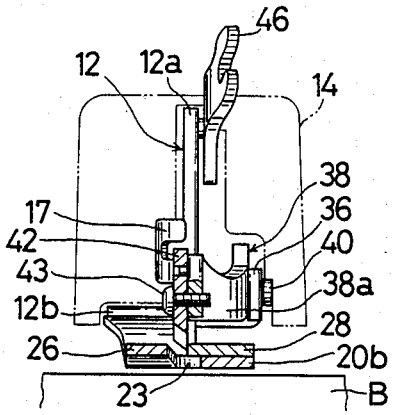
FIG. 5 is a sectional view taken along line V—V in FIG. 3.
Figure 6:
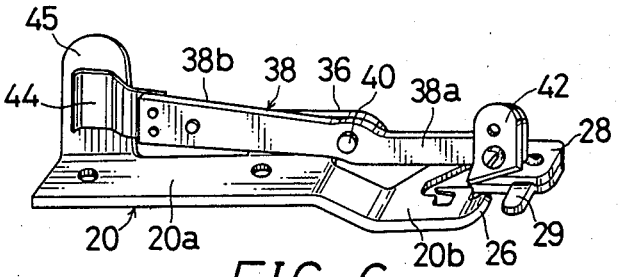
FIG. 6 is a perspective view of the presser foot, with the swing lever for the cutting blade mounted thereon.

In this embodiment, although the pins 22 are secured to the base plate 12 and the presser foot 20 is movable relative to the base plate 12, this arrangement may be changed. The pins 22 may be secured to the presser foot 20, and the base plate 12 may be designed to move relative to the pins 22. Further, although the pins 22 extend vertically to the bed B, they may be arranged to extend horizontally to the bed B As shown in FIGS. 3, 5 and 6, the presser foot 20 has a vertical support plate 36 extending from one side of the front portion 20*a*. A swing lever 38 is pivotally supported by the support plate 36 through a pin 40. The swing lever 38 has a curved arm portion 38*a* extending to the laterally central region of the presser foot 20

(FIG. 3) and a straight arm portion 38b extending to the front end of the front portion 20a. A cutting blade 42 is secured to the end of the arm portion 38a through a screw 43, and laterally abuts on the fixed blade 28 (FIG. 5). As with the pins 22 previously described, the pin 40 has an enlarged shank portion 40a and a reduced shank portion 40b. The swing lever 38 is secured to the pin 40 by crimping the end of the reduced shank portion 40b. The support plate 36 is loosely positioned on the enlarged shank portion 40a which is longer than the width of the support plate 36. Thus, the swing lever 38 may be swung both vertically and laterally.

As best shown in FIG. 6, a spring plate 44 is fixed to the other end of the swing lever 38 and abuts on a retaining plate 45 vertically extending from the front end of the front portion 20a of the presser foot 20. The spring plate 44 normally urges the swing lever 38 in the direction of arrow X shown in FIG. 3, so that the cutting blade 42 is held in pressing contact with the fixed blade 28.

The driving mechanism for the swing lever 38 will now be described with reference to FIG. 7. As shown therein, the driving mechanism includes a first lever 46 and a second lever 50. The first lever 46 is pivotally supported on an upper portion of the wall portion 12a of the base plate 12 through a pin 48, and has a short arm portion 46a and a long arm portion 46b. The second lever 50 is pivotally connected at one end to the short arm portion 46a of the first lever 46 and at the other end to the straight arm portion 38b of the swing lever 38 through pins 52 and 54, respectively.

The long arm portion 46b of the first lever 46 has a slot 56 in which a shaft $S_1$ of the needle clamp S is received. Thus, the first lever 46 is vertically pivotable about the pin 48 in accordance with the vertically reciprocating movement of the needle bar R. Also, the first lever 46 is axially movably supported on the pin 48, as with the pins 22 and the pin 40 previously described. Thus, when the securing position of the needle clamp S laterally shifts depending on the sewing machine, the attachment 10 may be mounted on the sewing machine. Further, the differences of the securing positions in vertical and longitudinal directions may conveniently accommodated by the slot 56.

Figure 7:
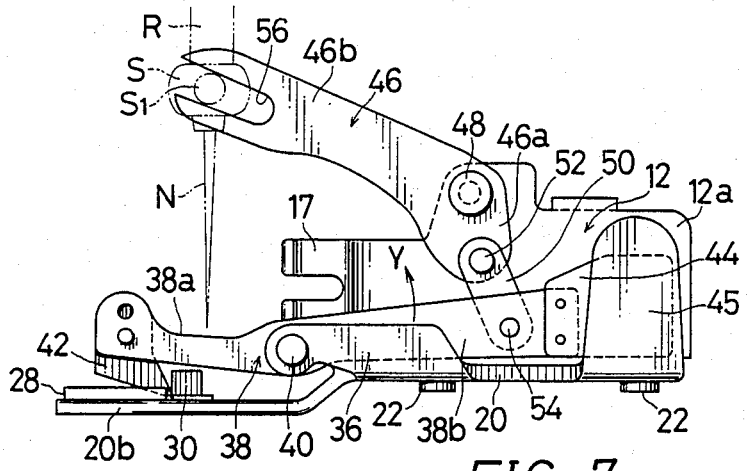
FIG. 7 is a rear view of the attachment shown in FIG. 2, showing the position of the driving mechanism when the needle bar is in its uppermost position.

With the driving mechanism constructed as described above, as the needle bar R is lowered from its uppermost position shown in FIG. 7, the connecting point of the pin 52 is moved upward. As this occurs, the swing lever 38 is swung in the direction of arrow Y and thence, the cutting blade 42 is lowered relative to the fixed blade 28. It is to be noted that the range of swinging movement of the swing lever 38 is determined such that the cutting blade 42 is in contact with the fixed blade 28 at all times. Also, the swing lever 38 will not swing as soon as the needle bar R lowers. The specific movement of the swing lever 38 will be explained later.

Figure 9:
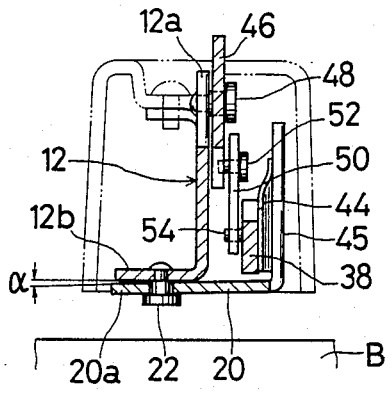
FIG. 9 is a sectional view taken along line IX—IX in FIG. 3.

The positional relation among the pins 48, 52 and 54 is such that when the needle bar R is in its uppermost position shown in FIG. 7, the pin 52 is located in front of the straight line extending between the pin 48 and the pin 54. In this position, as shown in FIG. 9, the presser foot 20 is inclined about the pins 22 to the base portion 12b of the base plate 12 at an angle $\alpha$ in a counterclockwise direction, and the upper surface of the front portion 20a of the presser foot 20 is in contact with the lower surface of the base portion 12b adjacent the wall portion 12a.

As the first lever 46 is swung downward from this position, the pins 48, 52 and 54 are approximated to form a straight line, so that the distance between the pins 48 and 54 becomes longer. The presser foot 20 is then inclined to the base portion 12b of the base plate 12. When the pins 48, 52 and 54 are aligned in a straight line, the upper surface of the presser foot 20 is in contact with the lower surface of the base portion 12b remote from the wall portion 12a and is inclined at the angle $\alpha$ in the opposite direction.

As the first lever 46 is further swung downward, the distance between the pins 48 and 54 becomes shorter. The presser foot 20 is inclined in the counterclockwise direction until it returns to its original position where the upper surface of the presser foot 20 is in contact with the lower surface of the base portion 12b adjacent the wall portion 12a.

During the movement of the first lever 46 so far, the swing lever 38 will not move since it is urged on the retaining plate 45 through the spring plate 44.

Figure 8:
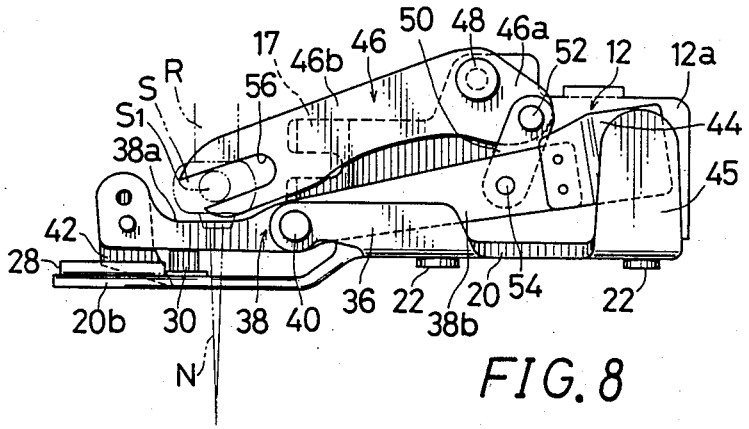
FIG. 8 is a view similar to FIG. 7, but showing the position of the driving mechanism when the needle bar is in its lowermost position.

When the first lever 46 is further lowered, the pin 52 is further moved rearward and upward and thence, the swing lever 38 is swung in the direction of arrow Y shown in FIG. 7, and simultaneously therewith, the cutting blade 42 is moved downward in scissors-fashion as it is pressed against the fixed blade 28 under the biasing force of the spring plate 44. When the needle bar R reaches its lowermost position, the levers 38, 46 and 50 are brought to the position shown in FIG. 8. When the needle bar R is raised from the lowermost position, the levers 38, 46 and 50 are returned to their original positions shown in FIG. 7, in the reverse order of the above movements.

Figure 10:
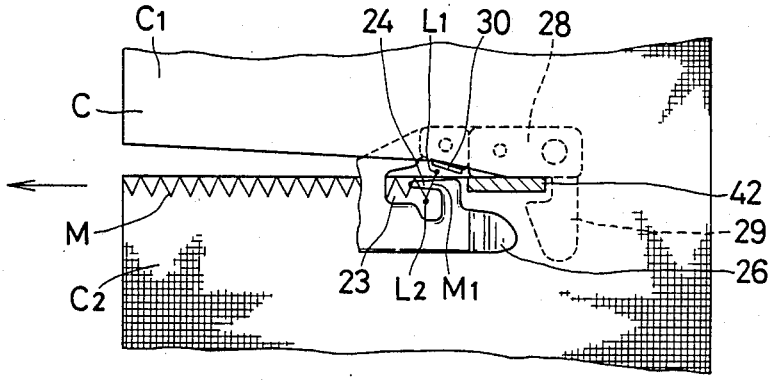
FIG. 10 is a schematic representation illustrating the work cutting operation performed by the cutting blade and the fixed blade, and the subsequent sewing operation performed by the machine.

Referring now to FIG. 10, the operation of the attachment 10 will be described in relation to the hemstitching operation of a sewing machine.

As shown in FIG. 10, the work fabric C to be cut and hemstitched is fed forward along the upper surfaces of the fixed blade 28 and the guide section 29, as it is cut by the cutting blade 42 and the fixed blade 28 in accordance with the vertically reciprocating movement of the needle bar R. The work fabric C is cut into a first fabric section or trim $C_1$ to be removed and a second fabric section $C_2$ to be hemstitched. The trim $C_1$ is directed by the guide member 30 in a direction away from the fabric sectIon $C_2$. On the other hand, the fabric section $C_2$ is guided by the bent portion 26 and is fed into the rear portion 20b and the feed dog K (not shown in FIG. 10). When the fabric section $C_2$ reaches below the needle clearance aperture 23, it is hemstiched by thread M as the needle N moves between the needle locations $L_1$ and $L_2$. The work cutting position of the cutting blade 42 is such that the edge of the cut section $C_2$ is located slightly laterally of the needle location $L_1$. In addition, the projection 24 which extends into the needle clearance aperture 23 is located along the edge of the fabric section $C_2$. Thus, during the sewing process, the lateral portion $M_1$ of the thread M overrides the projection 24 and is held thereby, preventing possible shrinkage of the fabric section $C_2$.

During the cutting operation by the cutting blade 42 and the fixed blade 28, the cutting blade 42 is pressed against the fixed blade 28 at all times, ensuring the positive cutting of the work fabric C. In addition, the presser foot 20 is laterally swung in response to the vertically reciprocating movement of the needle bar R, and therefore, the fixed blade 28 and the cutting blade 42 are also swung laterally, thus permitting cut of a thick fabric.

An important feature of the present invention resides in the fact that both of the fixed blade 28 and the cutting blade 42 are supported on the presser foot 20. The base plate 12 is provided solely with a mechanism for transmitting the vertically reciprocating movement of the needle bar R to the swing lever 38 supporting the cutting blade 42. Thus, the attachment 10 may be manufactured by using a reduced number of components, thereby providing a compact construction adapted for economical manufacture. Because of the compact construction of the attachment 10, the cutting region of the work fabric C can be easily observed and hence, the cutting and sewing operation can be performed more reliably. In addition, since the fixed blade 28 is located immediately behind the needle clearance aperture 23, the fabric C may be sewn immediately after it has been cut, thereby preventing improper stitching due to possible shifts of the fabric section Cz to be sewn.

While the invention has been described with reference to a preferred embodiment thereof, it is to be understood that modifications and variations may be easily made without departing from the spirit of this invention which is defined by the appended claims.

What is claimed is:

1. A work cutting attachment for use with a zigzag sewing machine having a presser bar, an endwise reciprocating needle bar with means mounting said needle bar for vertical movement, and a feed dog, comprising:

a base plate, means for removably securing said base plate to said presser bar;

a presser foot mounted on said base plate for holding a work fabric against said feed dog and having a needle clearance aperture;

a fixed blade secured to said presser foot;

a cutting blade;

a support mechanism supporting said cutting blade for vertical movement relative to said fixed blade; and a driving mechanism including means for operatively connecting said needle bar and said support mechanism for transmitting the vertical movement of said needle bar through said support mechanism to said cutting blade so as to move the latter vertically relative to said fixed blade.

2. The work cutting attachment as defined in claim 1 wherein said presser foot is connected to said base plate through a plurality of pins, the presser foot and base plate having a combined thickness, each pin having a shank of a length greater than the combined thickness of said presser foot and said base plate, and wherein said presser foot and said base plate each has a plurality of holes, each hole of said presser foot having a diameter larger than that of the shank of said pin and each hole of said base plate having a diameter substantially equal to that of the shank of said pin such that the shank of said pin is loosely inserted into said hole of said presser foot and closely inserted into said hole of said base plate, said pin having an end secured to said base plate.

3. The work cutting attachment as define din claim 1 wherein vertical movement of the cutting blade imparted by said driving mechanism is limited to a range within which said cutting blade cooperates with said fixed blade at all times, and wherein said support mechanism includes spring means of pressing said cutting blade against said fixed blade.

4. The work cutting attachment as defined in claim 1 wherein said support mechanism includes a swing lever pivotally supported on said presser foot, and wherein said cutting blade is secured to one end of said swing lever.

5. The work cutting attachment as defined in claim 4 wherein said driving mechanism includes a first lever pivotally supported on said base plate and having one end operatively connected to said needle bar, and a second lever having one end pivotally connected to said first lever remote from said one end of said first lever, said second lever having a second end pivotally connected to said wing lever remote from said one end of said swing lever.

6. The work cutting attachment as defined in claim 1 including means for allowing lateral swinging movement of said presser foot relative to said base plate in response to operation of said drive mechanism.

* * * * *

UNITED STATES PATENT AND TRADEMARK OFFICE

CERTIFICATE OF CORRECTION

PATENT NO. : 4,984,525

DATED : January 15, 1991

INVENTOR(S) : Mikio Mori

It is certified that error appears in the above-identified patent and that said Letters Patent is hereby corrected as shown below:

Column 8, line 18, "define din" should read --defined in--.

Column 8, line 37, "wing" should read --swing--.

Signed and Sealed this

Twelfth Day of May, 1992

*Attest:*

DOUGLAS B. COMER

*Attesting Officer*

*Acting Commissioner of Patents and Trademarks*